US010997817B2

(12) United States Patent
Hendricks et al.

(10) Patent No.: US 10,997,817 B2
(45) **Date of Patent: *May 4, 2021**

(54) SYSTEMS AND METHODS FOR ELECTRONIC GAMING

(71) Applicant: Aristocrat Technologies Australia Pty Limited, Macquarie Park (AU)

(72) Inventors: Bradley Hendricks, Las Vegas, NV (US); Thomas Tuomey, Las Vegas, NV (US)

(73) Assignee: Aristocrat Technologies Australia Pty Ltd., North Ryde (AU)

( * ) Notice: Subject to any disclaimer, the term of this patent is extended or adjusted under 35 U.S.C. 154(b) by 0 days.

This patent is subject to a terminal disclaimer.

(21) Appl. No.: 16/780,689

(22) Filed: Feb. 3, 2020

(65) Prior Publication Data

US 2020/0175810 A1 Jun. 4, 2020

Related U.S. Application Data

(63) Continuation of application No. 16/736,173, filed on Jan. 7, 2020, which is a continuation of application No. 15/274,358, filed on Sep. 23, 2016, now Pat. No. 10,535,219.

(60) Provisional application No. 62/233,478, filed on Sep. 28, 2015.

(51) Int. Cl.
*G07F 17/32* (2006.01)
*G07F 17/34* (2006.01)

(52) U.S. Cl.
CPC ..... *G07F 17/3213* (2013.01); *G07F 17/3209* (2013.01); *G07F 17/3225* (2013.01); *G07F 17/3246* (2013.01); *G07F 17/3251* (2013.01); *G07F 17/34* (2013.01)

(58) Field of Classification Search
CPC ..... G07F 17/3213; G07F 17/3209; G07F 17/3225; G07F 14/34; G07F 17/3251
See application file for complete search history.

(56) References Cited

U.S. PATENT DOCUMENTS

| | | | | |
|---|---|---|---|---|
| 5,816,915 | A * | 10/1998 | Kadlic | G07F 17/32 463/13 |
| 8,512,127 | B2 | 8/2013 | Jaffe et al. | |
| 8,734,223 | B2 | 5/2014 | Zoble et al. | |
| 9,159,199 | B2 | 10/2015 | Jaffe et al. | |
| 10,535,219 | B2 * | 1/2020 | Hendricks | G07F 17/3209 |
| 2002/0047238 | A1 | 4/2002 | Ainsworth et al. | |
| 2003/0207709 | A1 | 11/2003 | Paotrakul | |

(Continued)

*Primary Examiner* — Jay Trent Liddle
*Assistant Examiner* — Alex P. Rada, II
(74) *Attorney, Agent, or Firm* — Armstrong Teasdale LLP

(57) ABSTRACT

An electronic gaming system includes a game controller configured to control a display device to present a game area, where the game area is configured to display a plurality of reel strips. Further, the game controller may select a reel layout for at least one reel strip, where the selected reel layout specifies a size of at least one oversized symbol and a location of the at least one oversized symbol on the symbol display positions of the at least one reel strip. In addition, the game controller may select a first oversized symbol corresponding to the size of the at least one oversized symbol specified by the selected reel layout, and/or add the first oversized symbol to the at least one reel strip at the location specified by the reel layout.

20 Claims, 7 Drawing Sheets

(56) References Cited

U.S. PATENT DOCUMENTS

| | | | | |
|---|---|---|---|---|
| 2004/0192431 | A1* | 9/2004 | Singer | G07F 17/3244 463/20 |
| 2006/0189381 | A1* | 8/2006 | Daniel | G07F 17/3232 463/29 |
| 2007/0024002 | A1* | 2/2007 | McMain | G07F 17/32 273/274 |
| 2008/0058084 | A1 | 3/2008 | Saito | |
| 2008/0146319 | A1 | 6/2008 | Yoshizawa | |
| 2008/0254854 | A1* | 10/2008 | Slomiany | G07F 17/32 463/19 |
| 2009/0117983 | A1 | 5/2009 | Visser | |
| 2009/0227338 | A1 | 9/2009 | Yoshizawa | |
| 2010/0029381 | A1* | 2/2010 | Vancura | G07F 17/3244 463/30 |
| 2011/0223985 | A1 | 9/2011 | Mizue | |
| 2014/0087830 | A1 | 3/2014 | Gobe et al. | |
| 2014/0274288 | A1 | 9/2014 | Hornick et al. | |
| 2015/0011291 | A1 | 1/2015 | Nauman | |
| 2015/0332542 | A1 | 11/2015 | Zoble et al. | |
| 2016/0027241 | A1 | 1/2016 | Jaffe et al. | |
| 2016/0093148 | A1 | 3/2016 | Hawkins et al. | |
| 2016/0093152 | A1 | 3/2016 | Hendricks et al. | |
| 2016/0247361 | A1 | 8/2016 | Meyer | |
| 2016/0314661 | A1 | 10/2016 | Vann | |
| 2017/0092046 | A1* | 3/2017 | Hendricks | G07F 17/3209 |
| 2017/0148254 | A1 | 5/2017 | Hornik et al. | |
| 2020/0143629 | A1* | 5/2020 | Hendricks | G07F 17/34 |

* cited by examiner

SYSTEMS AND METHODS FOR ELECTRONIC GAMING

CROSS-REFERENCE TO RELATED APPLICATIONS

This application is a continuation and claims the benefit of U.S. patent application Ser. No. 16/736,173, filed Jan. 7, 2020, which is a continuation and claims the benefit of U.S. patent application Ser. No. 15/274,358, now U.S. Pat. No. 10,535,219, filed Sep. 23, 2016, which claims the benefit of priority to U.S. Provisional Patent Application No. 62/233,478, filed Sep. 28, 2015, all of which are hereby incorporated by reference in their entirety.

BACKGROUND

The subject matter of the present disclosure relates to a method of electronic gaming, an electronic gaming system, and an article of manufacture for electronic gaming. Conventional gaming systems may employ symbol-driven jackpots, in which a jackpot prize is awarded based upon a winning combination of symbols. A need exists for alternative gaming systems.

SUMMARY

In one aspect, an electronic gaming system is provided. The electronic gaming system includes a game controller configured to control a display device to present a game area that includes a plurality of reel strips. Further, the game controller may select reel layout from a table of reel layouts, where the selected reel layout specifies a size of at least one oversized symbol and a location of the at least one oversized symbol on the symbol display positions of the at least one reel strip of the plurality of reel strips. In addition, the game controller may, in at least some embodiments, select a first oversized symbol corresponding to the size of the at least one oversized symbol specified by the selected reel layout in response to selection of the reel layout, and/or add the first oversized symbol to the at least one reel strip of the plurality of reel strips at the location of the at least one oversized symbol specified by the reel layout.

In another aspect, a method is provided. The method variously includes selecting a reel layout, where the selected reel layout specifies a size of at least one oversized symbol and a location of the at least one oversized symbol on the symbol display positions of at least one reel strip of the plurality of reel strips. In addition, in at least some embodiments, the method may include selecting a first oversized symbol corresponding to the size of the at least one oversized symbol specified by the selected reel layout in response to selection of the reel layout, and/or adding the first oversized symbol to the at least one reel strip of the plurality of reel strips at the location of the at least one oversized symbol specified by the reel layout.

BRIEF DESCRIPTION OF THE DRAWINGS

An exemplary embodiment of the subject matter disclosed will now be described with reference to the accompanying drawings.

DETAILED DESCRIPTION

Figure 1:
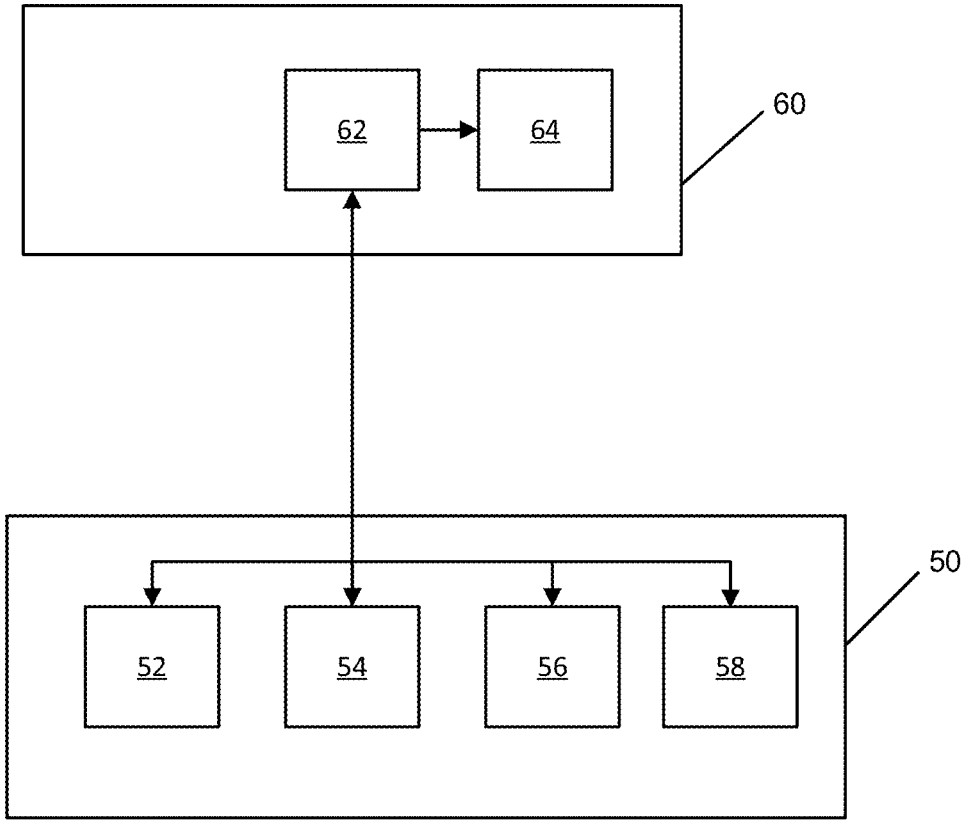
FIG. 1 is a block diagram of the exemplary components of a gaming machine.

Referring to the drawings, a gaming system that includes a game controller is shown. The game controller comprises components that enable the implementation of an electronic wagering game in which a plurality of reel strips may be formed based upon the selection of a plurality standard, or base, symbols as well as upon the selection of one or more oversized symbols. Oversized symbols may be larger than base symbols and may be inserted within or added to a reel strip in place of or overtop of a plurality of base symbols. Thus, a reel strip may be formed, such that the reel strip includes a plurality of base symbols and one or more oversized symbols. Game outcomes may be based upon the selection of a plurality of base symbols and/or oversized symbols, and various awards may be generated based upon each game outcome.

General Construction of an Exemplary Gaming System

The present disclosure may be implemented in various configurations for gaming machines, including but not limited to: (1) a gaming machine in which the computerized instructions for controlling one or more games are stored within the gaming machine prior to delivery to a gaming establishment; and/or (2) a changeable gaming machine in which the computerized instructions for controlling one or more games are subsequently downloaded to the gaming machine through a data network after the gaming machine is installed within in a gaming establishment.

In an exemplary embodiment, the computerized instructions for controlling one or more games may be executed by a server, such as, for example, a central controller or remote host. In such a "thin client" architecture, the server may remotely control one or more games, or other suitable interfaces, via a gaming network, and the gaming machine may be used to display the games, or suitable interfaces, and to receive inputs or commands from a player.

In another exemplary embodiment, the instructions for controlling one or more games are communicated from a server to a local processor and memory coupled within a gaming machine. In such a "thick client" architecture, a processor of the gaming machine may execute the communicated instructions to control the game or games and/or other suitable interfaces provided to a player.

In another exemplary embodiment, one or more gaming machines within a gaming machine network may utilize a thin client architecture and one or more gaming machines within a gaming machine network may utilize a thick client architecture. Similarly, in various exemplary embodiments, certain functions of a particular gaming machine may be implemented in a thin client architecture and certain other functions of the gaming machine may be implemented in a thick client architecture. For instance, instructions for controlling a game or games may be communicated from a server to one or more network gaming machines operating in a thick client configuration, while instructions for controlling any secondary games or bonus gaming functions may executed by the server in a thin client configuration.

Figure 2:
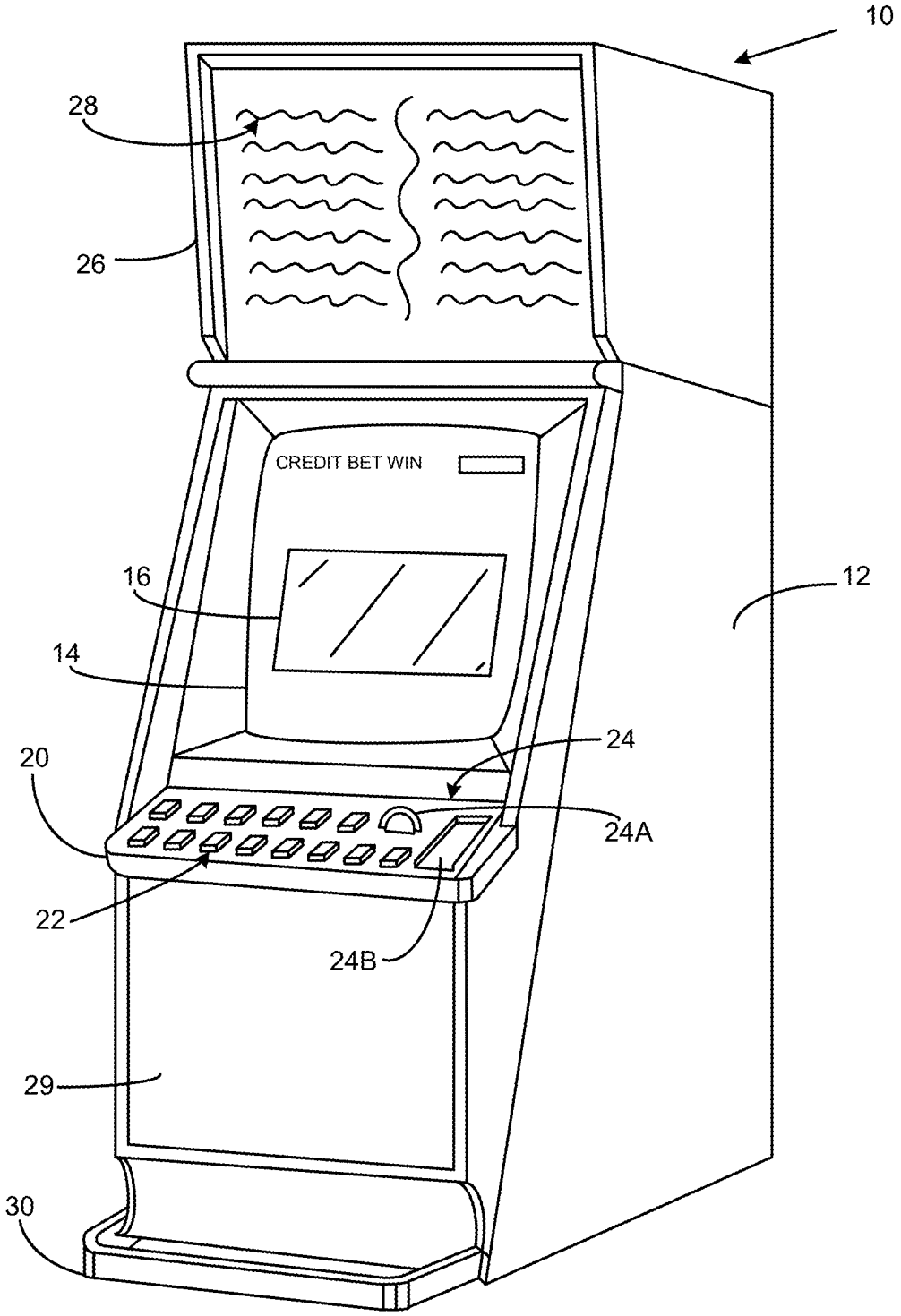
FIG. 2 is a perspective view of an exemplary gaming machine.

FIG. 2 is a perspective view of an exemplary gaming machine 10. Gaming machine 10 may include a support structure, housing, console or cabinet 12 that provides support for a plurality of interface units, displays, inputs, controls and other features of a conventional gaming machine. Gaming machine 10 may be configured so that a player can operate it while standing or sitting. Moreover, gaming machine 10 may be positioned on a base or stand, or can be configured as a pub-style table-top game (not shown) that a player can operate while seated. Gaming machine 10 may include varying numbers and styles of cabinets 12, display configurations, and the like without departing from the scope of the present disclosure.

In an exemplary embodiment, gaming machine 10 may include a display 14. Gaming machine 10 may further include a mid-trim 20, which may house a bank of buttons 22 for enabling a player to interact with gaming machine 10 and/or a credit input mechanism 24.

Gaming machine 10 may also include a player marketing module configured to scan or read a player tracking device, such as, for example a loyalty or player tracking card implemented within a casino as part of a loyalty program. The player tracking device may be in the form of a card, flash drive, and/or any other portable storage medium capable of being read by the reading device. In some embodiments, the player marketing module may be configured to transfer credits between gaming machine 10 and the player tracking device.

Gaming machine 10 may further include a top box 26, which may, in turn, include artwork 28, such as, for example, artwork depicting one or more pay tables, bonus award information, an upper display (not shown), and/or other game information or imagery. Further artwork and/or information may be provided on a front panel 29 of console 12. A coin tray 30 may be mounted beneath front panel 29 for dispensing cash payouts from gaming machine 10.

Display 14 may include, without limitation, a monitor, a television display, a plasma display, a liquid crystal display (LCD) a display based on light emitting diodes (LED), a display based on a plurality of organic light-emitting diodes (OLEDs), a display based on polymer light-emitting diodes (PLEDs), a display based on a plurality of surface-conduction electron-emitters (SEDs), a display including a projected and/or reflected image or any other suitable electronic device or display mechanism. In an exemplary embodiment, display 14 includes a touch-screen or touch-sensitive screen. In various embodiments, display 14 may be of any suitable size and configuration, such as any circular, square, rectangular, or other geometric configuration.

Display 14 may be further configured to provide haptic feedback. Top box 26 may also include a display, which may be of the same or different from display 14.

Display 14 may, in various embodiments, display a game and/or accept game play data from a player. Moreover, display 14 may also display information relating to an interactive game, wager triggering event, or wagering outcome. In an exemplary embodiment, an upper display (not shown) mounted in top box 26 may display any wagering outcome, any suitable secondary game associated or not associated with the interactive game, or any information relating to the interactive games. The upper display may also be configured to accept game play data from a player.

Display 14 may, in addition, serve as digital signage operable to advertise one or more games or other aspects of the gaming establishment. In an exemplary embodiment, gaming machine 10 may also include a credit or fund display 20, which may display a player's current number of credits, cash accumulated, account balance, an original number of credits the player funded the gaming machine with, or an equivalent of any of the aforementioned, and the like. Moreover, in an exemplary embodiment, display 14 may display an amount being wagered or a player's accumulated winnings.

In an exemplary embodiment, and as described in greater detail herein, display 14 may display at least one game or game image, game symbol or symbols, and game indicia, such as any visual representation or exhibition of a movement of objects, including, for example, any mechanical, virtual, or video reels and wheels, dynamic lighting, video images, images of people, characters, places, things and faces of cards, and the like. In various embodiments, the symbols, images and indicia described above may be displayed mechanically, such as by one or more mechanical or physical reels. In other words, display 14 may include any electromechanical device, such as one or more rotatable or spinning wheels, reels or dice, any of which may be configured to display at least one or a plurality of games or other suitable images, symbols or indicia.

FIG. 1 is a block diagram of an exemplary player interface 50 and game controller 60 of gaming machine 10. Player interface 50 and game controller 60 may be housed within gaming machine 10, such as on a printed circuit board located within cabinet 12 of gaming machine 10. As described herein, player interface 50 may be arranged to enable manual interaction between a player and the gaming system and for this purpose includes various input/output components required for the player to enter instructions to play the game and observe the game outcomes.

Components of player interface 50 may include at least one credit input mechanism 24, at least one display 14, a game play mechanism 56 (including one or more input devices that enable a player to input game play instructions or place a wager), and/or one or more audio output devices 58 (e.g., one or more speakers).

Game controller 60 may be in data communication with player interface 50 and may include at least one processor 62 or other suitable controller, such as a microprocessor, a microcontroller-based platform, a suitable integrated circuit or one or more application-specific integrated circuits (ASICs). Processor 62 may be coupled in communication with, or may be operable to access or to exchange signals with, at least one data storage module or memory 64. Processor 62 may thus be configured to retrieve game play instructions from memory 64, process the game play instructions in accordance with game play rules, and output one or more game play outcomes to display 54.

Memory 64 may comprise any suitable tangible, non-transitory, computer-readable storage medium. Memory 64 may store program code and instructions, executable by processor 62, to control gaming machine 10. Memory 64 may also store other data, such as, for example, image data, one or more pay tables or pay table data, event data, player input data, random or pseudo-random number generators, or numbers generated by a random number of pseudo-random number generator, look-up table data, and/or information and applicable game rules that relate to the play of gaming machine 10.

Figure 3:
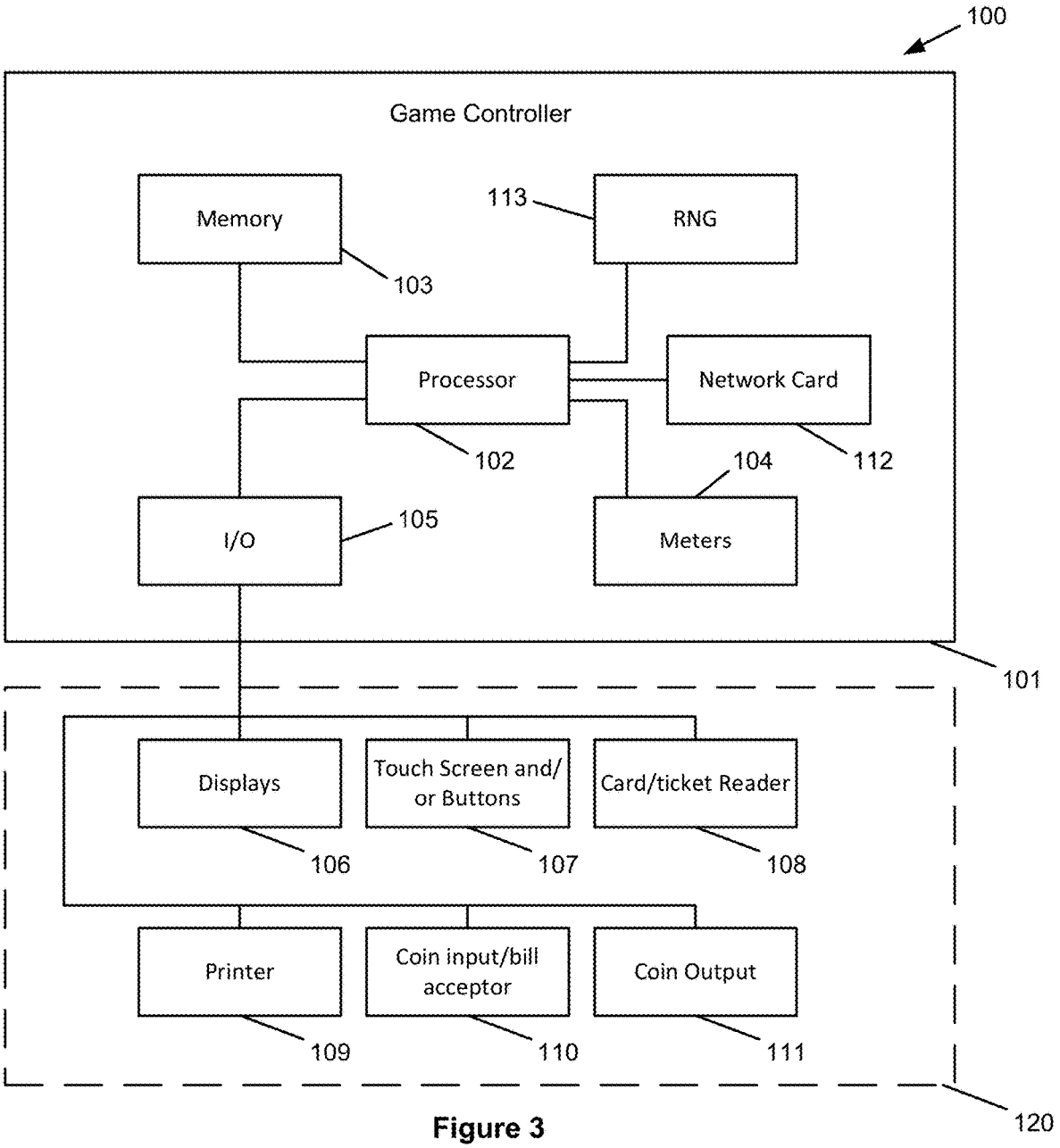
FIG. 3 is a block diagram of exemplary components of a gaming machine.
Figure 4:
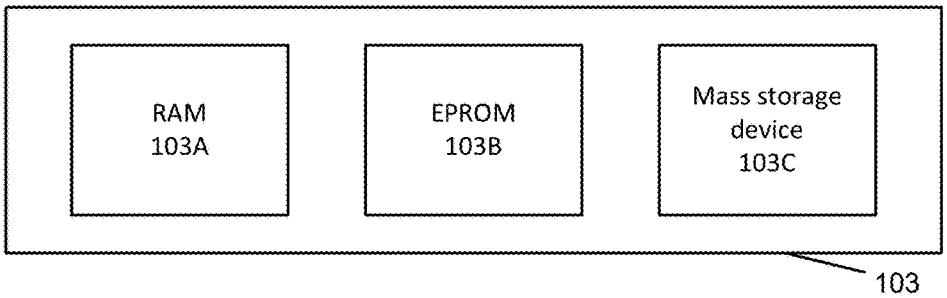
FIG. 4 is a schematic diagram of exemplary components of a memory.

With brief attention to FIG. 4, a block diagram of memory 64 is shown. Memory 64 may, in various embodiments, comprise a memory 103 (as described herein with reference to FIG. 3). Memory 103 may include random access memory (RAM) 103A, such as non-volatile RAM (NVRAM), magnetic RAM (MRAM), ferroelectric RAM (FeRAM) and other forms as commonly understood in the gaming industry. Memory 103 may further include read only memory (ROM), such as EPROM 103B or electrically erasable programmable read only memory (EEPROM). Memory 64 may further include one or more mass storage devices 103C, such as one or more hard drives, one or more solid state or flash memory components, one or more CD and/or DVD drives, and the like. Any other suitable magnetic, optical, and/or semiconductor memory may be used to operate in conjunction with gaming machine 10 that enables gaming machine 10 to function as described herein.

In an exemplary embodiment, RAM 103A may temporarily store one or more program files (and/or other related data) for execution by processor 62. EPROM 103B may comprise a boot ROM device and/or may contain some system or game related code. Mass storage device 103C may store one or more game programs, the integrity of which may be verified and/or authenticated by the processor 62 through the use of protected or encrypted code stored, for example, on EPROM 103B.

In various embodiments, part or all of the program code and/or operating data described above is stored in a detachable or removable memory, including, but not limited to, a suitable cartridge, disk, CD ROM, DVD or USB memory device. In addition, in various embodiments, all or part of the program code and/or operating data described above may be downloadable to memory 64 by way of any suitable computer network.

In an exemplary embodiment, a desktop computer, a laptop personal computer, a personal digital assistant (PDA), a smartphone, a tablet computing device or other portable computing device, and/or any other computerized platform may implement the computing operations of the present disclosure. For example, any suitable mobile computing device, such as any smartphone or tablet computing device, may implement and enable gameplay as described herein. It should be appreciated that each gaming machine 10 disclosed herein may comprise a device that has obtained approval from a regulatory gaming commission or a device that has not obtained approval from a regulatory gaming commission. It should also be appreciated that processor 62 and memory 64 may be collectively referred to herein as a "computer" or "controller."

Returning to FIG. 1, in an exemplary embodiment, credit input mechanism 24 may be coupled in communication with processor 62. Credit input mechanism 24 may include any suitable credit input mechanism or device, such as a coin input chute 24A, a bill or ticket collector 24B, and the like. Credit input mechanism may be configured to receive any suitable monetary credit, such as money, coins, tokens, tickets, and the like. In various embodiments, credit input mechanism 24 may further comprise card reader devices, such as credit or debit card readers or validators for credit cards, debit cards, printed ticket printers and/or readers, and the like.

In various embodiments, a player may insert an identification card (not shown) into a card reader of gaming machine 10. The identification card may be a smart card that includes a programmed microchip or a magnetic strip coded with a player's identification, credit totals (or related data) and other relevant information. A player may further carry a portable device, such as a cell phone or smart phone, a radio frequency identification tag or any other suitable wireless communication device, which communicates a player's identification, credit totals (or related data) and other relevant information to gaming machine 10. In an embodiment, money may be transferred to gaming machine 10 via an electronic funds transfer process. When a player funds gaming machine 10, processor 62 may determine an amount of funds entered and display the corresponding amount on the display 14.

Game play mechanism 56 may include at least one input device that is coupled in communication with processor 62. An input device may include any device that enables a player to produce an input signal that is receivable by processor 62. For example, in one embodiment, after funding gaming machine 10, the input device may comprise a game activation device, such as a pull arm or one or more play button 22 that enables the player to start the game or a sequence of events in gaming machine 10. Play button 22 may comprise any suitable play activator such as a bet one button, a max bet button, or a repeat the bet button. In an embodiment, after appropriate funding of gaming machine 10, game play may begin automatically.

In an exemplary embodiment, one input device may comprise a "Bet One" button. A player may place a wager or bet by pushing the Bet One button and may increase the wager by repeatedly depressing or selecting the Bet One button. In various embodiments, an input device comprises a "Bet Max" button that enables a player to place a maximum wager permitted during a particular game or game session.

In various embodiments, an input device may also comprise a "Cash Out" button. A player may depress or select a Cash Out button to receive a cash payment or other suitable form of payment corresponding to the number of credits remaining. In an embodiment, when the player cashes out, the player receives coins or tokens in a coin payout tray. A player may further receive tickets or credit slips, or the player's electronically recordable identification card may be funded, in response to selection of a Cash Out button.

In various embodiments, an input device may comprise a touch-screen that is coupled to a touch-screen controller, or some other touch-sensitive display overlay, to enable player interaction with images presented on display 14. A touch-screen and/or touch-screen controller may be communicatively coupled to a video controller, such that a player may provide input signals to gaming machine 10 by physically manipulating or interacting with the touch-screen.

Gaming machine 10 may include a sensor, such as a camera (not shown) coupled in communication with processor 62. The camera may, in various embodiments, be controlled by processor 62, such that a player may direct the orientation and focus of the camera to acquire an image of a player actively playing gaming machine 10 and/or a surrounding area of gaming machine 10. In an exemplary embodiment, the camera may selectively acquire still or moving (e.g., video) images and may be configured to acquire the images in either an analog, digital, or other suitable format. Display 14 may be configured to display the image acquired by the camera, as well as to display the visible manifestation of the game in split screen or picture-in-picture fashion. For example, the camera may acquire an image of the player and processor 62 may incorporate that image into the interactive and/or secondary game as a game image, symbol or indicia.

FIG. 3 illustrates a more detailed block diagram of various exemplary functional components of a gaming machine 100, which may be the same as or different from gaming machine 10 (as shown in FIG. 2). The foregoing description of components (e.g., display 14, player interface 50, and game controller 60) may therefore apply to the description of similar components in gaming machine 100. For instance, processor 62 may be the same as or different from 102, as described below. Similarly, memory 64 may be the same as or different from the memory 103, as described below.

Accordingly, gaming machine 100 may include a game controller 101 (which may include a processor 102 mounted on a circuit board, a described in greater detail above). Instructions and data to control operation of processor 102 may be stored in a memory 103 that is in data communication with processor 102. Gaming machine 100 may include both volatile and non-volatile memory and more than one of each type of memory, with such memories being collectively represented by memory 103.

Gaming machine 100 may further include hardware meters 104 (to ensure regulatory compliance and to monitor player credit) and/or an input/output (I/O) interface 105 (for communicating with peripheral devices of gaming machine 100). Input/output interface 105 and/or the peripheral devices may comprise intelligent devices with their own memory for storing associated instructions and data. A random number generator module 113 may generate random numbers for use by processor 102. Persons skilled in the art will appreciate that random number generator module 113 includes a pseudo-random number generator.

In an exemplary embodiment, a player interface 120 includes peripheral devices that communicate with game controller 101 including one or more displays 106, a touch screen and/or input buttons 107 (which provide a game play mechanism), and a credit input mechanism, such as a card and/or ticket reader 108, a printer 109, a bill acceptor and/or coin input mechanism 110, and a coin output mechanism 111. The credit input mechanism is configured to receive a credit wager to initiate play of a base game, and establish a credit balance (e.g., using the received credit wager) that is increasable and decreasable based on wagering activity within a game. Player interface 120 also includes a payout mechanism such as a printer 109 and/or a coin output mechanism 111. The payout mechanism is configured to output a payout to a player of gaming machine 100 based on an outcome of the game (e.g., a base game and/or a feature game).

Additional hardware may be included as part of gaming machine 100, or hardware may be omitted as required for the specific implementation. For example, although buttons or touch screens are typically used in gaming machines to allow a player to place a wager and to initiate a play of a game any input device that enables the player to input game play instructions may be used. For example, in some gaming machines a mechanical handle may be used to initiate a play of the game. Persons skilled in the art will also appreciate that a touch screen can be used to emulate other input devices, such as, for example, a touch screen that can display virtual buttons that a player can "press" by touching the screen where they are displayed.

In addition, gaming machine 100 may include a communications interface, such as, for example a network card 112. Network card 112 may, for example, send status information, accounting information and/or other information to a bonus controller, central controller, server or database and receive data or commands from the bonus controller, central controller, an/or server or database. In various embodiments (e.g., embodiments that employ a player marketing module), communications over a network may be via the player marketing module—e.g., the player marketing module may be in data communication with one or more of the above devices.

In various embodiments, components of gaming machine 100 may be distributed. For example, in an embodiment, input/output devices 106, 107, 108, 109, 110, and 111 may be provided remotely from game controller 101.

Figure 5:
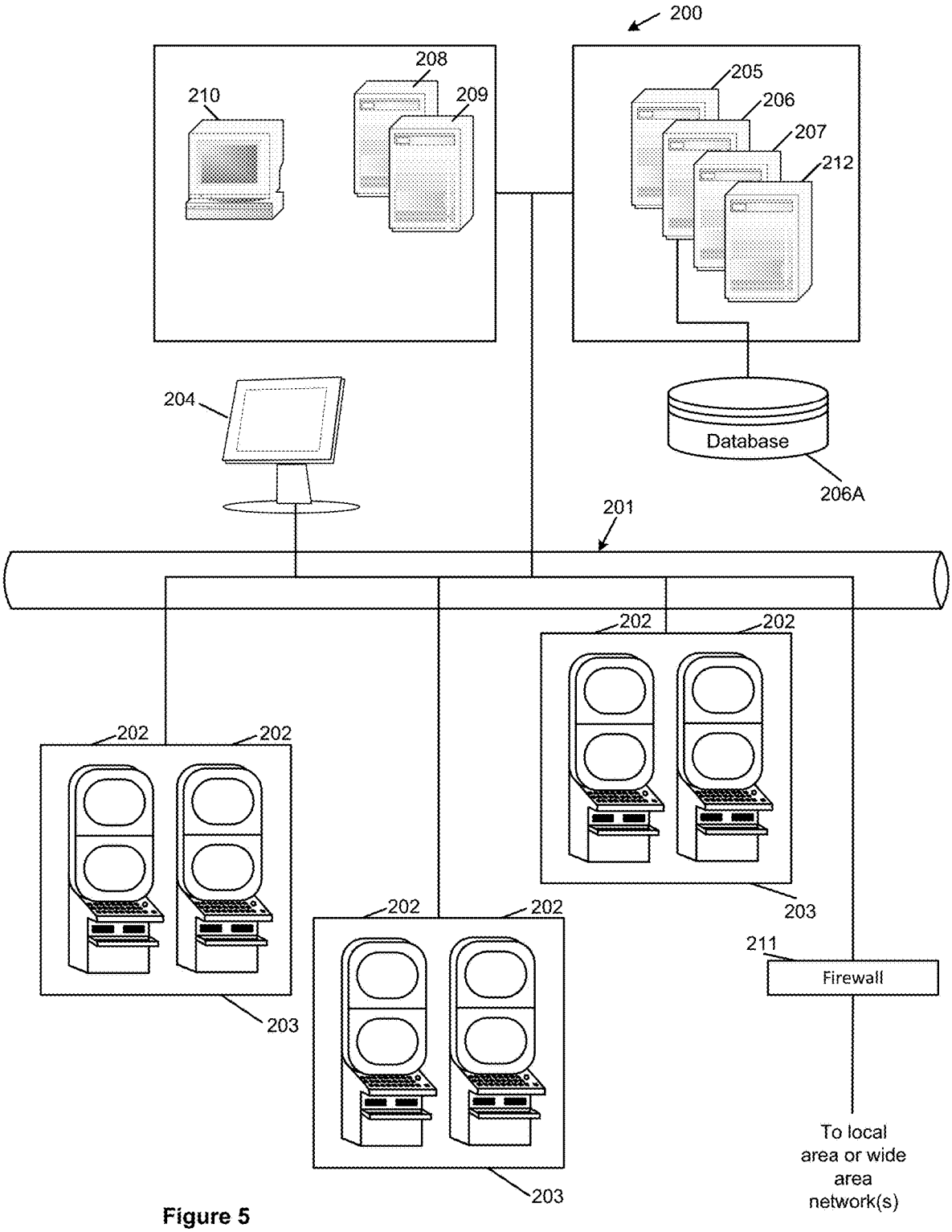
FIG. 5 is a schematic diagram of an exemplary network gaming system.

FIG. 5 illustrates such an exemplary distributed gaming system 200. Gaming system 200 may include a network 201, which, for example, may comprise a wired or wireless network, such as a Wi-Fi or BLUETOOTH network, an Ethernet network, an RS-232 network, and/or any combination thereof. In an exemplary embodiment, gaming machines 202, shown arranged in three banks 203 of two gaming machines 202, are connected to network 201. Gaming machines 202 may provide a player operable interface and may be the same as (or substantially similar to) the gaming machines 10 and 100 (as shown in FIGS. 2 and 3), or may have simplified functionality depending, for example, on various game play requirements.

One or more displays 204 may also be connected to network 201. For example, displays 204 may be associated with one or more banks 203 of gaming machines. Displays 204 may be used to display representations associated with game play on gaming machines 202 and/or used to display other representations, such as, for example promotional or informational material. Displays 204 may be the same as or substantially similar to display 14, as described above.

In a thick client embodiment, game server 205 may implement part of the game played by a player using gaming machine 202, and gaming machine 202 may implement part of the game. In such an embodiment, insofar as both game server 205 and gaming machine 202 may implement part of the game, they may collectively comprise a game controller. A database management server 206 may manage storage of game programs and associated data for downloading or access by gaming machines 202 in a database 206A. Typically, if gaming system 200 enables players to participate in a jackpot game, a jackpot server 207 may be provided to perform accounting functions for the jackpot game. A loyalty program server 212 may also be provided.

In a thin client embodiment, game server 205 may implement most or all of the game played by a player using gaming machine 202, and gaming machine 202 may, in essence, function provide little more than the player interface. In such an embodiment, game server 205 may comprise the game controller. Gaming machine 202 may thus receive player instructions and transmit those instructions to game server 205. Further, in a thin client embodiment, gaming machines 202 may be computer terminals, such as, for example, personal computers, laptop computers, tablet computing devices, smartphones, and the like running software that provides a player interface. Other client/server configurations are contemplated and are within the scope of this disclosure. Additional details of a client/server architecture may be found in WO 2006/052213 and PCT/SE2006/000559, the disclosures of which are incorporated herein by reference in their entireties.

One or more servers may be provided to assist in the administration of gaming system 200. Such servers may include, for example, a gaming floor management server 208, and a licensing server 209 to monitor the use of licenses relating to particular games. An administrator terminal 210 may be provided to allow an administrator to run network 201 and the devices connected to network 201.

Gaming system 200 may communicate with other gaming systems and/or other local networks, such as, for example a corporate network, and/or a wide area network such as the Internet Communications may be filtered through a firewall 211.

Persons skilled in the art will appreciate that in accordance with known techniques, functionality at the server side of network 201 may be distributed over a plurality of different computers. For example, elements may be run as a single "engine" on one server or a separate server may be provided. For example, game server 205 may implement a random number generator engine. Alternatively, a separate random number generator server may be provided. Further, persons skilled in the art will appreciate that a plurality of game servers may be provided to implement different games or a single game server may implement a plurality of different games as required by the terminals.

Further Details of an Exemplary Gaming System

In an exemplary embodiment, a player may place a wager using the game play mechanism 56. A game (or game session) may be initiated in response to placement of the wager, a plurality of symbols randomly drawn, and a game (or game session) outcome determined based upon the symbols drawn. A game outcome may be compared to a pay table (which may be stored in a computer memory) to determine a payout or award (also referred to herein as a win entitlement). Persons skilled in the art will appreciate that a player's wager can be varied from game to game dependent on player selections.

In various embodiments, a wager may include a selection of a number of lines to be played during a game session. Such lines may comprise an interconnected combination of symbol display positions. Each selected line may be evaluated to identify winning combinations of symbols. A pay table (e.g., a pay table stored in memory 64) may be referenced to identify a payout or award based upon an identified winning combination of symbols. In various embodiments, an award may be multiplied or increased by a multiplication factor as well.

In an exemplary embodiment, gaming machine 202 may generate an award that is not based solely upon a number of a lines selected. For example, "scatter" pays (e.g., randomly selected awards that are not identified based upon a plurality of adjacent symbols) may be awarded independently of a player's selection of pay lines.

Further, in various embodiments, a player may select a number of reels (virtual or physical) to play. Games of this type are marketed under the trade name "Reel Power" by Aristocrat Leisure Industries Pty Ltd and are also known as "ways" to win games. Such a reel selection option may permit the substitution of one displayed symbol for another. In other words, all symbols displayed at symbol display positions corresponding to a selected reel may be used to form symbol combinations with symbols displayed at designated symbol display positions of the other reels. For example, if there are five reels and three symbol display positions for each reel, such that the symbol display positions comprise three rows of five symbol display positions, the symbols displayed in the center row may be used for non-selected reels. As a result, the total number of ways to win may be determined by multiplying the number of active display positions of each reel, the active display positions being all display positions of each selected reel and the designated display position of the non-selected reels. In this example, for five reels and fifteen display positions, there are 243 ways to win.

As described in greater detail below, a symbol display may comprise a matrix (e.g., a rectangular matrix) of symbol display positions. The matrix of symbol display positions may, in turn, comprise a plurality of columns and a plurality of rows. In various embodiments, the number of symbol display positions associated with a column may vary from one column to the next. For example, in an exemplary embodiment, a symbol display may include five columns, in which the first column, the third column, and the fifth column include three symbol display positions and in which the second and fourth columns include four symbol display positions (e.g., a 3-4-3-4-3 column formation). Such a column formation includes seventeen display positions. Moreover, in such a formation, adjacent columns may be offset or staggered relative to one another.

Figure 6:
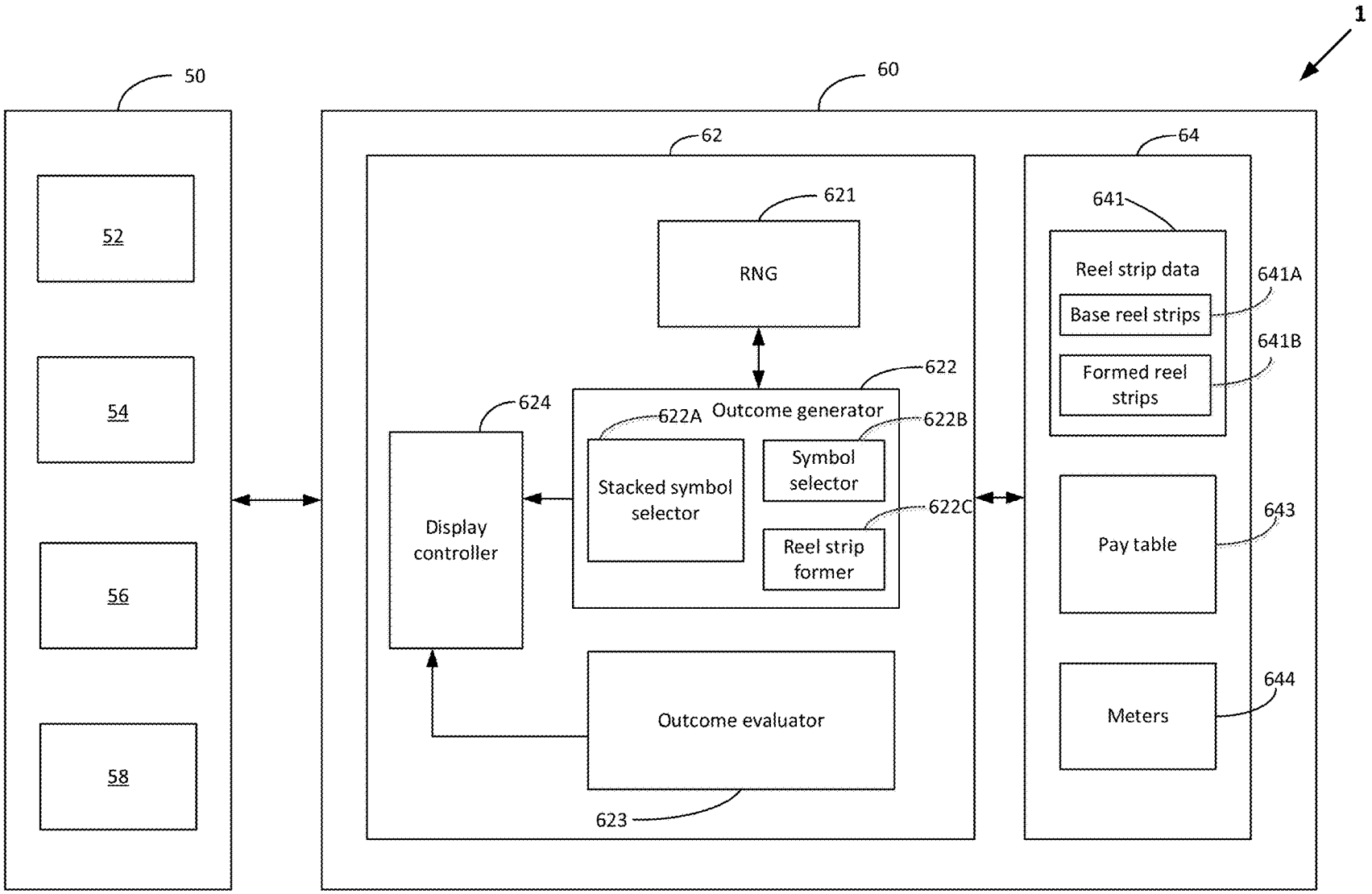
FIG. 6 is a block diagram of an exemplary gaming system.

FIG. 6 illustrates a block diagram of an exemplary gaming system that includes a plurality of software modules. Processor 62 of game controller 60 is shown implementing a number of such modules based on program code and data stored in memory 64. Persons skilled in the art will appreciate that one or more of the modules could be implemented in some other way, such as, for example by a dedicated circuit.

As used herein, a "reel strip," may comprise a plurality of symbols displayed within a column of symbol display positions. In addition, as used herein, a "stack" of symbols may comprise those symbols disposed within a particular column or reel strip. In an exemplary embodiment, a "full stack" of symbols may refer to a column of symbols or a reel strip in which each of the symbol display positions comprising the column or strip is associated or filled with a particular symbol, such as a jackpot symbol.

In an exemplary embodiment, outcome generator 622 may generate reel strips during each play of the game by determining a plurality of symbols and stack arrangements for each reel strip. In this respect, symbol data 641 may be used to fill symbol display positions of one or more reel strips 641A. As used herein, a "base reel strip" may include a plurality of symbols (e.g., predefined or preselected symbols) into which or over which one or more oversized symbols (or stacks of oversized symbols) may be added or placed. Thus, a base reel strip may comprise a reel strip having symbols over which oversized symbols may be placed. Further, in an exemplary embodiment, outcome generator 622 may generate base reel strips during play of each game for oversized symbol placement and display.

Stack symbol selector 622A of outcome generator 622 may determine whether to insert one or more symbols, or stacks of symbols, into base reel strips 641A based upon random numbers generated by a random number generator 621. In an embodiment, stack symbol selector 622A may constrain or limit the oversized symbols selected for insertion within base reel strips to ensure that the selected oversized symbols do not overlap with each other. More particularly, stack symbol selector 622A may ensure the stacked oversized symbols do not share (or are not assigned for insertion into) a common reel strip.

The oversized symbols selected for insertion may be constrained to one or more base reel strips, because, once an oversized symbol is selected to occupy a plurality of reel strips, those reel strips may spin together under control of the display controller 624. In other words, if overlap were permitted between oversized symbols, a plurality of reel strips (e.g., all of the reel strips) might spin together, thereby limiting the number of possible outcomes available during a particular game. Thus, oversized stacked symbols may be constrained for insertion to selected reel strips to ensure that reel strips associated with different oversized symbols do not overlap with each other and, as such, that the reel strips spin independently of one another.

In an exemplary embodiment, and as described below, a game may be played based upon any number of reel strips, such as, for example, six reel strips. Each reel strip may correspond to one of a plurality of spinning reels. Further, in this example, oversized symbols may be two, three and four symbol positions wide.

More particularly, symbol selection may be constrained by stacked symbol selector 622A. To constrain symbol selection, stacked symbol selector 622A may perform a random determination for each of the reel strips in a defined, or random, order. For example, symbol selector 622A may select oversized symbols from right to left or left to right. Where oversized symbols are selected from left to right, stacked symbol selector 622A may first determine whether to add a stacked oversized symbol a first reel strip, such as, for example, by obtaining a value from random number generator 621 and comparing the random number to a defined set of values that, the random number matches one of the defined values, an oversized symbol is selected for addition to the first reel strip. In an embodiment, if an oversized symbol is to be added, stacked symbol selector 622A may randomly select amongst a plurality of different oversized symbols, including stacked oversized symbols of different sizes.

In an exemplary embodiment, weightings may be applied in order to control the probability that a particular oversized symbol or stack of oversized symbols is random selected. Where, for example stacked symbol selector 622A selects for display on the first reel strip an oversized stack symbol that is two symbol display positions in height and two symbol display positions in width (e.g., a 2×2 oversized symbol), the selected oversized symbol may be added to the first and second base reel strips by the reel strip former 622C (because the 2×2 oversized symbol spans the width of the first and second reel strips). The first and second base reel strips may be stored, with the added oversized symbols, as a formed reel strip 641B. Stacked symbol selector 622A may continue, again, moving from left to right, to the next adjacent reel strip to determine, based upon a random number generated by random number generator 621, whether to add an oversized symbol or oversized symbols to the next adjacent reel strip (which may, in this example, be the third reel strip). For the purposes of illustration, and in this example, no oversized symbol is added to the third reel strip.

Stacked symbol selector 622A may proceed to the fourth reel strip, where stacked symbol selector 622A may exclude all stacked symbols that are four symbols wide from oversized symbol selection for the fourth reel strip, because an oversized symbol that is four symbols wide will not fit in the remaining three reel strips, each of which are one symbol position wide, and which are collectively three symbols wide. Stacked symbol selector 622A may therefore select a 3×3 oversized symbol (e.g., an oversized symbol that is three symbols in height and three symbols in width) for addition to the fourth through sixth reels. The formed reel strips 641B for the game described above may thus include the first and second reel strips having the 2×2 symbol added to them, the third reel in the form of the base reel strip, and the fourth, fifth and sixth base reel strips having added thereto the 3×3 oversized symbol.

Persons skilled in the art will appreciate that in other embodiments different techniques may be used to constrain the oversized symbol selection. For example, in one embodiment, a table of possible arrangements of oversized symbols may be defined. In another example, dimensions of the oversized symbols which are to be added to the base reel strips 641A may be defined, and oversized symbols capable of filling those dimensions may be selected In another embodiment, a table may define not only the arrangement of oversized symbols amongst the reel strips but also the identity of the symbol. Such arrangements may be weighted in order to control the probability of particular outcomes.

Once the reel strips are formed, a symbol selector 622B may select symbols from the formed reel strips 641B based upon one or more random numbers generated by random number generator 621. The selected symbols may be provided to the display controller 624 which may cause the selected symbols to be displayed on display 54 at a set of symbol display positions.

In an exemplary embodiment, symbol selector 622B may select symbols from formed reel strips 641B, where each formed reel strip 641B corresponds to a plurality of spinning reels. Formed reel strips 641B may specify a sequence of symbols for each reel. In an embodiment, symbol selector 622B may select the symbols for display by selecting a stopping position in the sequence. A probability table stored in memory 64 may be referenced to vary the odds of a particular stop position being selected. Other techniques can be used to control the odds of particular outcomes occurring to thereby control the return to player of the game. In this respect, where reels share an oversized symbol, only a single stopping position may need to be selected, for the reel strips sharing the oversized symbol, because, as described herein, the reel strips may spin together or in unison to accommodate the placement of the oversized symbol over each reel strip. Accordingly, symbol selector 622B may determine, based on the number of formed reels strips, a number of stopping positions. Thus, display controller 624 may display each reel strip, such that reel strips that share an oversized symbol are displayed spinning together.

In addition, once the selected symbols are selected or displayed, they may be evaluated in order to determine whether they include any winning outcomes. These evaluations may be made by outcome evaluator 623 based on pay table 643, which may define the winning outcomes and associated awards.

Figure 7:
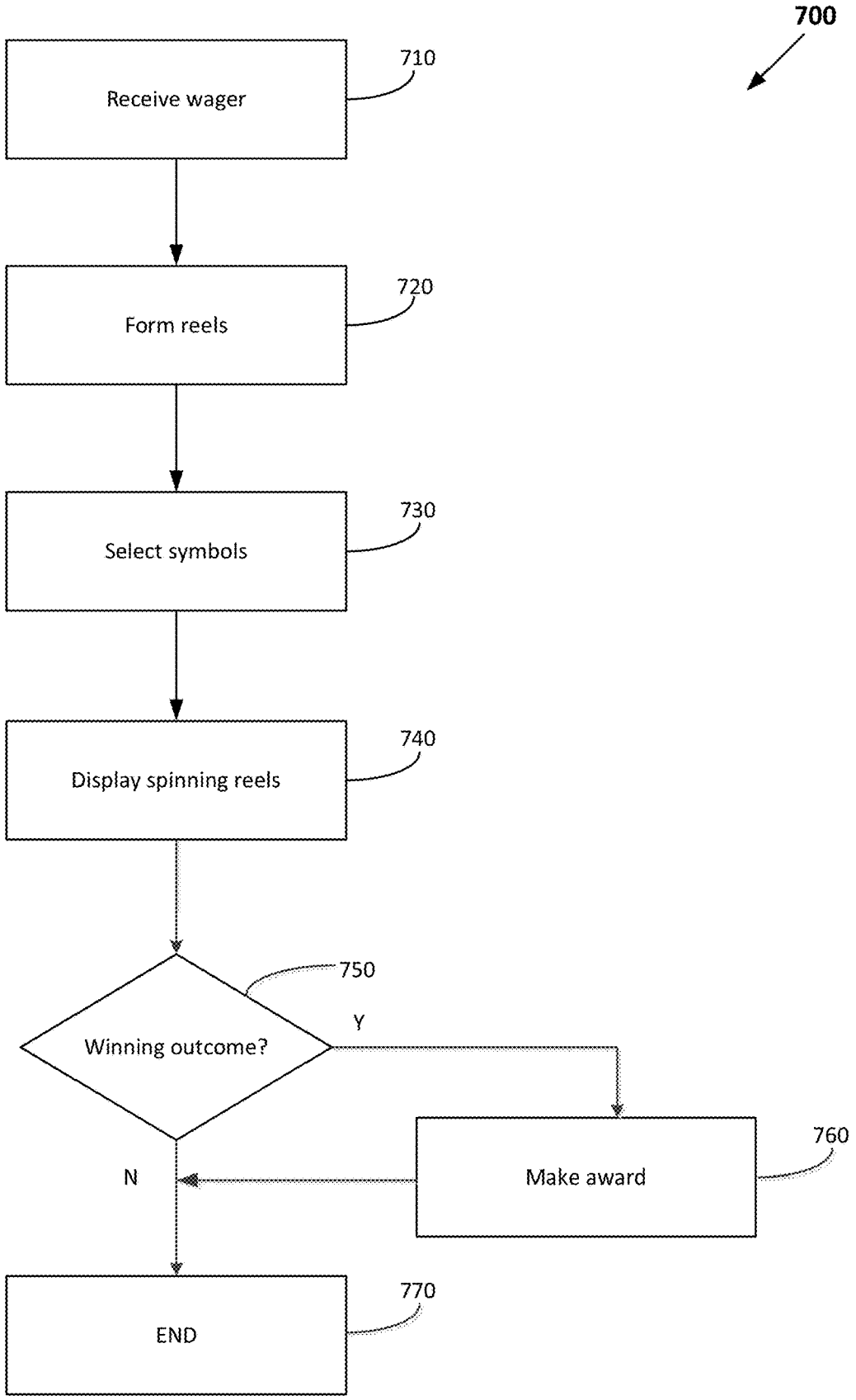
FIG. 7 is a flowchart of an exemplary method of electronic gaming.

Referring to FIG. 7, there is shown a method 700 of an embodiment of the invention. At step 710, gaming system 1 may receive a wager via game play mechanism 56 together with an instruction from the player to initiate play of the game. At step 720, outcome generator 622 may form one or more reel strips to produce, as described elsewhere herein, formed reel strips 641B. At step 730, symbol selector 622B may select symbols for display from formed reel strips 641B, and at step 740, display controller 624 may control display 54 to display spinning reel strips, during which the reel strips that share an oversized symbol are displayed spinning together. At step 750, outcome evaluator 623 may determine one or more winning outcomes based on a comparison of the selected symbols to pay table 643, and at step 760, outcome evaluator 623 may generate one or more awards in association with any winning outcome. After an award is made, or if there is no winning outcome, the game may ends at step 770, and another, subsequent game, may be initiated, as method 700 returns to step 710 for continuing game play. In some embodiments, an award may include an award of a feature game (e.g., a bonus or secondary game), and game play may continue to the feature game after step 760.

Further, in some embodiments, one or more eligibility criteria may be applied as a prerequisite to the addition of one or more stacks of oversized symbols. For example, an eligibility criterion may require that the player has placed a wager of a certain amount, placed an ante bet, selected all win lines, played a sufficient or predefined number of games, or that the player is a member of a loyalty program.

In an exemplary embodiment, a winning outcome may result in an award, such as an award of credits. Credits may not be physically received, or redeemed for cash, by a player. For example, the gaming systems described herein may provide a player with a double or nothing feature, which the player may select to double credits before commencing another play of the game or prior to cashing out. Further, as credits are fungible, once credits have been added to the credit meter it may not be possible to distinguish between credits which exist because the player has input cash or other credits and credits resulting from an award.

Further aspects of the method will be apparent from the above description of the system. It will be appreciated that at least part of the method will be implemented electronically, for example, digitally by a processor executing program code such as in the above description of a game controller. In this respect, in the above description certain steps are described as being carried out by a processor of a gaming system, it will be appreciated that such steps will often require a number of sub-steps to be carried out for the steps to be implemented electronically, for example due to hardware or programming limitations. For example, to carry out a step such as evaluating, determining or selecting, a processor may need to compute several values and compare those values.

Exemplary Embodiment

Figure 8:
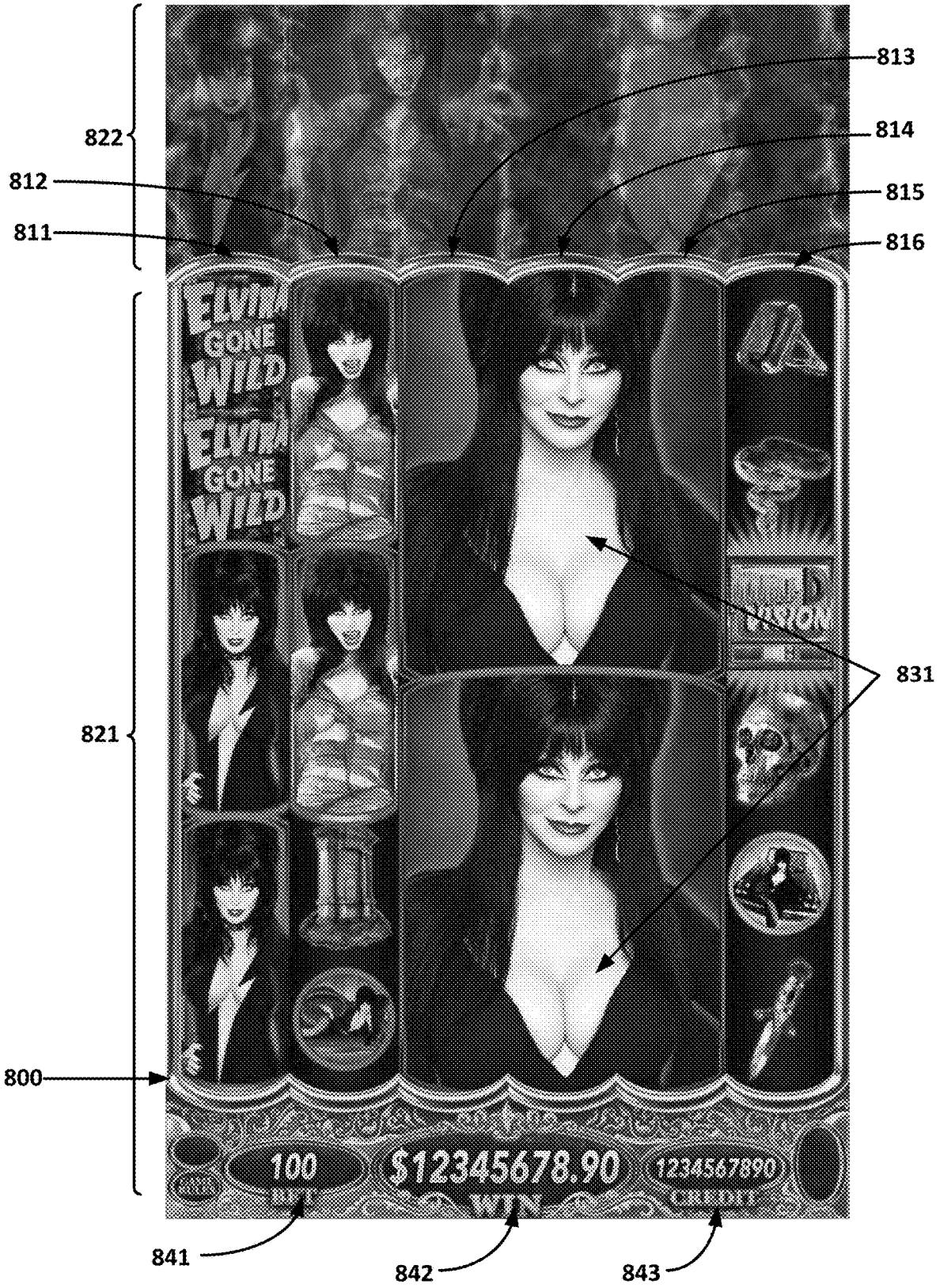
FIG. 8 is a screenshot of an exemplary embodiment.

In an exemplary embodiment, and with reference now to FIG. 8, a game may include an "Elvira" theme. The Elvira themed game described below may be played on a 6×6 reel strip area having 60 pay lines; however, those of skill will appreciate that any suitable number of reels strips may be incorporated in conjunction with any suitable number of pay lines. Stacks of oversized symbols, which may, in various embodiments, be referred to as "mega symbols," may be added to one or more reel strips during every base game spin, or during a selected number of base game spins that is less than every base game spin. In the exemplary embodiment, stacks of oversized symbols may be 2, 3 or 4 symbols wide. As described above, stacks of oversized symbols may be inserted into any reel strip, and once a plurality of reel strips are associated with an oversized symbol, in the exemplary embodiment, those reel strips may spin together. In addition, a plurality of different stacks of oversized symbols may be added to different reel strips during a particular spin. For example, and as shown, up to 3 different stacks of oversized symbols may be added to different reel strips during a particular spin.

Accordingly, the game area shown in FIG. 8 may be divided into an active game area 821 and an inactive game play area 822, which may be obscured or otherwise grayed out to indicate that the area is inactive. The game area may correspond, as described above, to six spinning reels, each of which is displayed as a reel strip in one of six columns of symbol display positions 811, 812, 813, 814, 815, and 816. Six rows of active symbol display positions 821 are also shown. In various embodiments, symbols may occupy two or more symbol display positions within a single column. An exemplary oversized stack of symbols 831 is shown. The oversized stack 831 includes 3×3 oversized symbols, which have been added to the reel strips corresponding to columns 813, 814, and 815. A bet meter 841, win meter 842, and credit meter 843 are also shown.

Further, and as shown, a stack of 2×2 "Mummy Elvira" themed oversized symbols may be added to reels 1 and 2, while a stack of 3×3 "Skull" themed oversized symbols may be added to reels 3, 4 and 5.

In addition, base game symbols may include one or more bonus scatter symbols, one or more themed symbols, such as, in the exemplary embodiment, one or more "Elvira" themed symbols, one or more "mid symbols," and one or more "low symbols."

Bonus scatter symbols may include, for example, one or more TV sets with the word "Bonus" or a feature logo displayed in association with one of a plurality of features. Bonus scatter symbols may also include one or more feature bonus symbols, such as the exemplary feature symbols appearing on the sixth reel 816. In addition, bonus scatter symbols may include various bonus features, such as those shown triggered with bonus symbols on the fourth and fifth reels 814 and 815, respectively, and a feature symbol on sixth reel 816.

Themed symbols, such as "Elvira" themed symbols may include, in various embodiments, a plurality of different images of a theme character, such as the character known as "Elvira." Each theme may utilize a different color scheme, such as a black (classic) color scheme, a red bustier color scheme, and a mummy color scheme.

In the exemplary embodiment, mid symbols may include symbols such as a vehicle themed symbol (e.g., the "Macabre Mobile" symbol, which is Elvira's customized Thunderbird) and movie reel symbol.

Further, in the exemplary embodiment, low symbols may include symbols such as a snake symbol, a skull-shaped goblet symbol, a grave stone symbol, a dagger symbol, a ring symbol, and a tarantula symbol.

In an exemplary embodiment, stacks of symbols may be composed of any base game symbol except scatter symbols. Mega symbols may be stacked up to any suitable height, such as, for example, to thirty-six symbol display positions high. However, the height of the symbol art may vary by symbol. For example, wild symbols may appear as 1×1, Elvira symbols may appear as 2×2, 3×3, or 4×6, and the low symbols may appear as 2×2, 3×3, or 4×3.

Further, in an exemplary embodiment, and in response to the occurrence of a trigger or trigger symbol (such as a random trigger), the active area 821 of the reels may "grow up" or expand vertically. A multiplier symbol may further appear in response to the occurrence of the trigger. Further still, an animation may react to the occurrence of a trigger. For example, an animated Elvira in the top screen may react as the reel strips bump into her and sparks go off around her. Further, in an exemplary embodiment, after a losing spin with a screen filled with stacks, the Elvira character may intervene and switch some of the stacks to wild symbols or matching symbols to generate an award.

As indicated above, the method may be embodied in program code. The program code could be supplied in a number of ways, for example on a tangible computer readable storage medium, such as a disc or a memory device, e.g. an EEPROM, (for example, that could replace part of memory 103) or as a data signal (for example, by transmitting it from a server). Further different parts of the program code can be executed by different devices, for example in a client server relationship. Persons skilled in the art, will appreciate that program code provides a series of instructions executable by the processor.

It will be understood to persons skilled in the art that many modifications may be made without departing from the spirit and scope of the disclosure, in particular it will be apparent that certain features of embodiments of the disclosure can be employed to form further embodiments.

It is to be understood that, if any prior art is referred to herein, such reference does not constitute an admission that the prior art forms a part of the common general knowledge in the art in any country.

In the claims which follow and in the preceding description, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the disclosure.

What is claimed is:

1. An electronic gaming system comprising:

a cabinet;

a display device supported by the cabinet;

a player input interface including a touch-screen input device, the player input interface supported by the cabinet; and a game controller enclosed by the cabinet and configured to execute instructions stored in a memory, which when executed by the game controller, cause the game controller to at least:

control the display device to present a game area, the game area configured to display a plurality of reel strips, each reel strip including a plurality of symbol display positions, each symbol display position having a symbol display position width and a symbol display position height;

select from a table of possible arrangements of oversized symbols, a size of at least one oversized symbol and a location of the at least one oversized symbol on the symbol display positions of at least one reel strip of the plurality of reel strips;

in response to the selection from the table, further select a first oversized symbol corresponding to the size of the at least one oversized symbol specified by the selection from the table;

add the first oversized symbol to the at least one reel strip at the location of the at least one oversized symbol specified by the selected arrangement;

generate a game outcome based, at least, on the first oversized symbol; and generate a game award from the game outcome.

2. The electronic gaming system of claim 1, wherein each of the arrangements of oversized symbols specifies sizes and locations of a plurality of oversized symbols on the at least one reel strip.

3. The electronic gaming system of claim 1, wherein the selected arrangements further specifies sizes of each of a plurality of oversized symbols and corresponding locations of each of the plurality of oversized symbols on the symbol display positions of the at least one reel strip, and wherein the instructions, when executed, further cause the game controller to at least:

select at least one additional oversized symbol corresponding to a size of at least one additional oversized symbol specified by the selected arrangement; and add the at least one additional oversized symbol to the at least one reel strip at the location of the at least one additional oversized symbol specified by the reel layout.

4. The electronic gaming system of claim 3, wherein the selected arrangement specifies the sizes and locations of each of the plurality oversized symbols to prevent overlap between the plurality of oversized symbols on the at least one reel strip, and wherein the instructions, when executed, further cause the game controller to at least:

add the selected at least one additional oversized symbol to at least two adjacent reel strips of the plurality of reel strips, whereby the at least one additional oversized symbol occupies adjacent symbol display positions of the at least two adjacent reel strips; and control the display device to simulate spinning and stopping the at least two adjacent reel strips in tandem to maintain a uniform rate of rotation of the at least one additional oversized symbol between the at least two adjacent reel strips.

5. The electronic gaming system of claim 4, wherein the instructions, when executed, further cause the game controller to at least:

control the display device to simulate stopping the at least two adjacent reel strips that include the at least one additional oversized symbol based upon a single stop position that is associated with only a single reel strip of the at least two adjacent reel strips, whereby the at least two adjacent reel strips are controlled and stopped as a single reel strip.

6. The electronic gaming system of claim 1, wherein the instructions, when executed, further cause the game controller to at least:

base the selection of the first oversized symbol upon a random number generated by a random number generator.

7. The electronic gaming system of claim 1, wherein the instructions, when executed, further cause the game controller to at least:

control the display device to display a first portion of the first oversized symbol in an active area of the game area, wherein a second portion of the first oversized symbol extends into an inactive area of the game area.

8. The electronic gaming system of claim 7, wherein the instructions, when executed, further cause the game controller to at least:

control the display device to expand the active area to include at least a portion of the inactive area, whereby at least the second portion of the first oversized symbol is contained in the expanded active area.

9. The electronic gaming system of claim 8, wherein the instructions, when executed, further cause the game controller to at least:

in response to expansion of the active area to include at least a portion of the inactive area, control the display device to display an interaction suggesting physical contact between the first oversized symbol and a game character that resides outside of and adjacent to the expanded active area.

10. The electronic gaming system of claim 9, wherein the instructions, when executed, further cause the game controller to at least:

in response to a losing outcome, control the display device to display a change from the losing outcome to a winning outcome by the game character, wherein the game character enters the active area to change the first oversized symbol to create the winning outcome.

11. A computer-implemented method of gaming implemented using a gaming system, the gaming system including a cabinet, a display device supported by the cabinet and configured to display an electronic game, a credit input mechanism supported by the cabinet, a touch-screen input device supported by the cabinet and configured to enable player interaction with the gaming system, and a game controller enclosed within the cabinet and including a processor configured to execute instructions for controlling the gaming system, the game controller communicatively coupled to the memory, the method comprising:

controlling, by the processor, the display device to present a game area, the game area configured to display a plurality of reel strips, each reel strip including a plurality of symbol display positions, each symbol display position having a symbol display position width and a symbol display position height;

selecting, by the processor, an arrangement for at least one reel strip of the plurality of reel strips, the selected arrangement specifying a size of at least one oversized symbol and a location of the at least one oversized symbol on the symbol display positions of the at least one reel strip;

in response to selection of the arrangement, selecting, by the processor, a first oversized symbol corresponding to the size of the at least one oversized symbol specified by the selected arrangement;

adding, by the processor, the first oversized symbol to the at least one reel strip at the location of the at least one oversized symbol specified by the arrangement;

generating, by the processor, a game outcome based, at least, on the first oversized symbol; and generating, by the processor, a game award from the game outcome.

12. The computer-implemented method of claim 11, wherein the arrangement is included in a table of arrangements, and wherein each arrangement in the table of arrangements defines an arrangement of oversized symbols, and wherein each arrangement of oversized symbols specifies sizes and locations of a plurality of oversized symbols on the at least one reel strip.

13. The computer-implemented method of claim 11, wherein the selected arrangement further specifies sizes of each of a plurality of oversized symbols and corresponding locations of each of the plurality of oversized symbols on the symbol display positions of the at least one reel strip, the method further comprising:

selecting, by the processor, at least one additional oversized symbol corresponding to a size of at least one additional oversized symbol specified by the selected arrangement; and adding, by the processor, the at least one additional oversized symbol to the at least one reel strip at the location of the at least one additional oversized symbol specified by the selected arrangement.

14. The computer-implemented method of claim 13, wherein the selected arrangement specifies the sizes and locations of each of the plurality oversized symbols to prevent overlap between the plurality of oversized symbols on the at least one reel strip, the method further comprising:

adding, by the processor, the selected at least one additional oversized symbol to at least two adjacent reel strips of the plurality of reel strips, whereby the at least one additional oversized symbol occupies adjacent symbol display positions of the at least two adjacent reel strips; and controlling, by the processor, the display device to simulate spinning and stopping the at least two adjacent reel strips in tandem to maintain a uniform rate of rotation of the at least one additional oversized symbol between the at least two adjacent reel strips.

15. The computer-implemented method of claim 14, further comprising:

controlling, by the processor, the display device to simulate stopping the at least two adjacent reel strips that include the at least one additional oversized symbol based upon a single stop position that is associated with only a single reel strip of the at least two adjacent reel strips, whereby the at least two adjacent reel strips are controlled and stopped as a single reel strip.

16. The computer-implemented method of claim 11, further comprising:

using a random number generator for the selection of the first oversized symbol.

17. The computer-implemented method of claim 11, further comprising:

controlling, by the processor, the display device to display a first portion of the first oversized symbol in an active area of the game area, wherein a second portion of the first oversized symbol extends into an inactive area of the game area.

18. The computer-implemented method of claim 16, further comprising:

controlling, by the processor, the display device to expand the active area to include at least a portion of the inactive area, whereby at least the second portion of the first oversized symbol is contained in the expanded active area.

19. The computer-implemented method of claim claim 18, further comprising:

in response to expansion of the active area to include at least a portion of the inactive area, controlling, by the processor, the display device to display an interaction suggesting physical contact between the first oversized symbol and a game character that resides outside of and adjacent to the expanded active area.

20. The computer-implemented method of claim 19, further comprising:

in response to a losing outcome, controlling, by the processor, the display device to display a change from the losing outcome to a winning outcome by the game character, wherein the game character enters the active area to change the first oversized symbol to create the winning outcome.

* * * * *